US005755067A

United States Patent [19]

Mercurio

[11] Patent Number: 5,755,067

[45] Date of Patent: May 26, 1998

[54] METHOD OF OVERLAPPING COMPOSITE BUILDING CONSTRUCTION WITH SUPERIOR THERMAL INSULATION EFFICIENCY

[76] Inventor: George A. Mercurio, P.O. Box 874007, Wasilla, Ak. 99687

[21] Appl. No.: 435,954

[22] Filed: May 5, 1995

[51] Int. Cl.[6] ..... E04B 2/02

[52] U.S. Cl. ..... 52/268; 52/265; 52/309.11; 52/309.14; 52/404.1

[58] Field of Search ..... 52/742.13, 742.14, 52/309.11, 404.1, 742.1, 265, 267, 268, 269, 407.3, 309.9, 309.14

[56] References Cited

U.S. PATENT DOCUMENTS

| | | | |
|---|---|---|---|
| 1,728,837 | 9/1929 | Slayter | 52/742.13 |
| 3,229,441 | 1/1966 | Heffner | 52/742.13 |
| 3,303,617 | 2/1967 | Hessburg, Jr. et al. | 52/742.13 X |
| 3,353,315 | 11/1967 | Barker | 52/309.11 |
| 3,611,653 | 10/1971 | Zinn | 52/407.3 |
| 3,686,815 | 8/1972 | Von Bose | 52/742.13 |
| 5,287,674 | 2/1994 | Sperber | 52/742.13 |

*Primary Examiner*—Michael Safavi
*Attorney, Agent, or Firm*—Alfred F. Hoyte, Jr.

[57] ABSTRACT

A composite insulated building structure which can be fabricated on site. Structural members are lined with secondary framing strips to minimize thermal conduction therethrough from interior to exterior walls. The structural members are applied in a staggered fashion to increase the effectiveness of the insulation. Interior and exterior walls of the structure are formed and then filled with insulation by pouring, thereby causing bonding of the insulation to the walls. Excess insulation material flows out into the unfilled structural void or over the top of the section to avoid undue stress on the shell.

1 Claim, 6 Drawing Sheets

METHOD OF OVERLAPPING COMPOSITE BUILDING CONSTRUCTION WITH SUPERIOR THERMAL INSULATION EFFICIENCY

BACKGROUND OF THE INVENTION

The invention relates generally to construction techniques and more particularly to a construction technique which reduces heat loss by employing an insulating method which results in a composite structure.

Buildings have traditionally been constructed with field-applied loose fill fibrous insulation in the open spaces between wood framing members. Structures built with field applied fibrous insulation frequently suffer from heat loss because of poorly fitted insulation and air intrusion due to poorly sealed vapor barriers and poorly fitted surface sheathing. The yearly freezing/thawing and the progressive packing down of wet insulation damages the structure, reduces the effective insulation and generates potential fire hazard where wet insulation is in contact with electrical outlets and wiring.

Another common construction technique for building construction is to assemble the structure using pre-insulated building panels with rigid insulation foam cores. These buildings typically experience fitting and joint connection problems. Handling and erecting the panels is difficult and dangerous for the workmen, and special lifting equipment is frequently required. Due to the bulk and weight of the prefabricated building panels, and the handling and shipping, damage during this process is common and expensive to repair.

Building panels with composite "stressed skin" wood panel facing bonded to rigid plastic insulation cores are also common, but these building systems are typically panel systems and do not achieve the continuity of in-place casting to develop continuous composite action between the rigid insulation core and the facing panels.

Metal-faced building panels are also common in the construction of commercial and residential structures, but these systems are also pre-manufactured and have similar joining and shipping problems to wood faced pre-manufactured building panels. The loss of structural and insulation continuity at door, window, and mechanical openings is generally more severe for metal faced panel systems.

The mobile housing industry incorporates building panel systems consisting of pre-assembled walls, roofs, and floors; however the systems are not assembled to develop continuous structural continuity.

Construction costs using pre-insulated building panels systems are generally higher than that of site assembled systems. For construction in remote areas, the transportation costs of pre-manufactured panels are prohibitive.

A particular problem associated with prior art insulated structures is heat loss caused by thermal conduction through structural support members where the support members are continuous from the exterior wall to the interior wall.

Another problem associated with prior insulated structures is overexpansion shell damage caused by pouring insulation between an interior wall and an exterior wall.

Another problem associated with conventional insulating structure is the use on non-conventional framing systems to accommodate the insulation.

Yet another problem associated with prior insulated structures is the formation of air pockets which degrade the flame resistant properties of the insulation material.

SUMMARY OF THE INVENTION

It is an object of this invention to provide a method of constructing a composite building structure with superior insulating properties.

It is another object of this invention to provide a method of constructing a composite building structure where insulation is improved by substantially preventing thermal conduction from interior walls to exterior walls through structural support members.

It is yet another object of this invention to provide a composite building structure which can be constructed on-site using conventional framing techniques.

It is yet another object of this invention to provide a composite building structure having increased air conditioning efficiency as well as heating efficiency.

It is yet another object of this invention to provide a composite building structure where defects which can develop during transportation are eliminated.

It is yet another object of this invention to provide a method of constructing an insulated structure which has a reduced fire hazard.

It is still another object of this invention to provide a method of constructing an insulated structure which prevents the formation of integral air pockets in the insulating material.

It is another object of this invention to provide an insulating building structure which is compatible with conventional electrical and mechanical systems.

These and other objects of the invention are accomplished by providing a composite insulated building structure which can be fabricated on site. Primary Structural members are lined with insulating secondary framing strips to minimize thermal conduction therethrough from interior to exterior walls. The structural members are applied in a staggered fashion to increase the effectiveness of the insulation. The structural core, including the secondary fretting strips, is erected using conventional framing materials and techniques. either the interior or exterior skin is applied during the initial framing process. The other skin is added one level at a time and then filled with insulation by pouring the proportioned insulation components causing bonding of the insulation to the wall framing and skins to form a composite shell structure.

The insulating pouring progresses in layers and each layer is allowed to fully expand into the unfilled voids in the structural element before pouring the next layer to avoid undue stress on the inner and outer skins.

BRIEF DESCRIPTION OF THE DRAWINGS

FIG. 2(*b*) shows a fragmentary sectional front view of the structure detailing the exterior wall, ground floor, and foundation.

DETAILED DESCRIPTION

Figure 1:
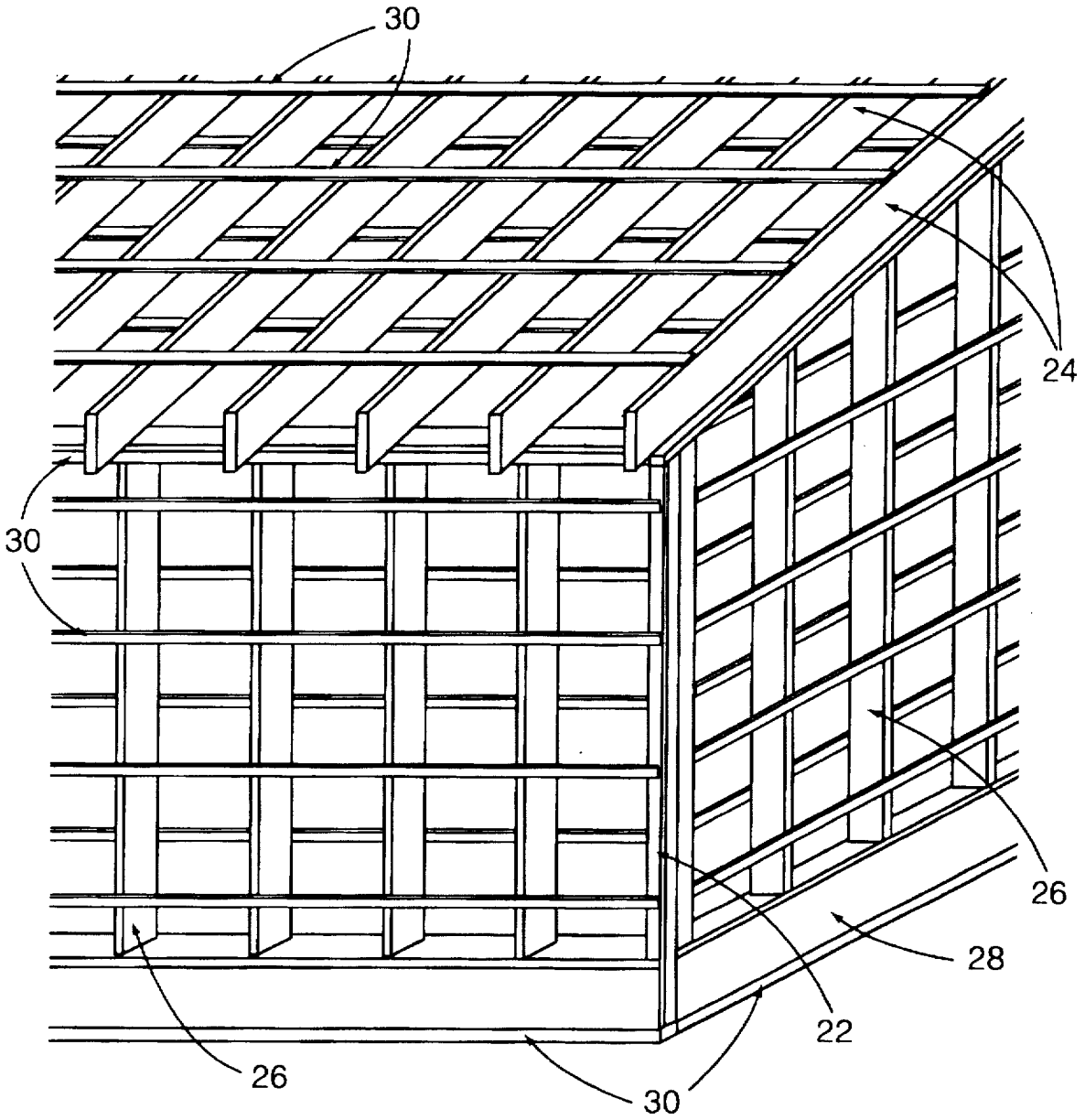
FIG. 1 shows a perspective view of the frame of the present invention detailing the arrangement of the structural members.

Referring now to FIG. 1 a perspective view of the framing members of the structure of the present invention is shown. the primary frame 20 uses the conventional core framing members 22 as the main support members in the roof 24, walls 26, and floor 28. The framing members 22 are securely fastened together to form a sub-frame assemble capable of supporting the structure.

Secondary overlapping support members 30, typically referred to as furring strips, are secured to the core framing members 22. The secondary overlapping support members are used to support shells for inner and outer walls, roof and ceiling, and floor panels. Secondary overlapping support members 30 are secured to opposite edges of the framing members 22 in a staggered fashion so that support members on opposite sides of the joists 22 are offset.

Arranging the support members 30 in a staggered fashion reduces thermal conduction through the support members 30 by not allowing a direct path for heat loss through core framing 22.

Referring again to FIG. 2(*a*) the structure is assembled on a conventional concrete or masonry foundation 38 with the ground floor 28 being supported above the crawl space 42 by a plurality of joists 22. The exterior wall skin 44 is secured to the transverse support members 30 by suitable fastening means such as nails. Insulation material 46 is bonded to the interior surface of the wall skin 44 as well as the core framing 22, support members 30, and the surface of the interior wall skin 48. It can be readily appreciated that the insulation is thinnest at the intersection of the wall 26, floor 28, and roof 24 core framing members 22 and some unavoidable heat loss will occur at these points in order to preserve structural integrity .

Figure 2A:
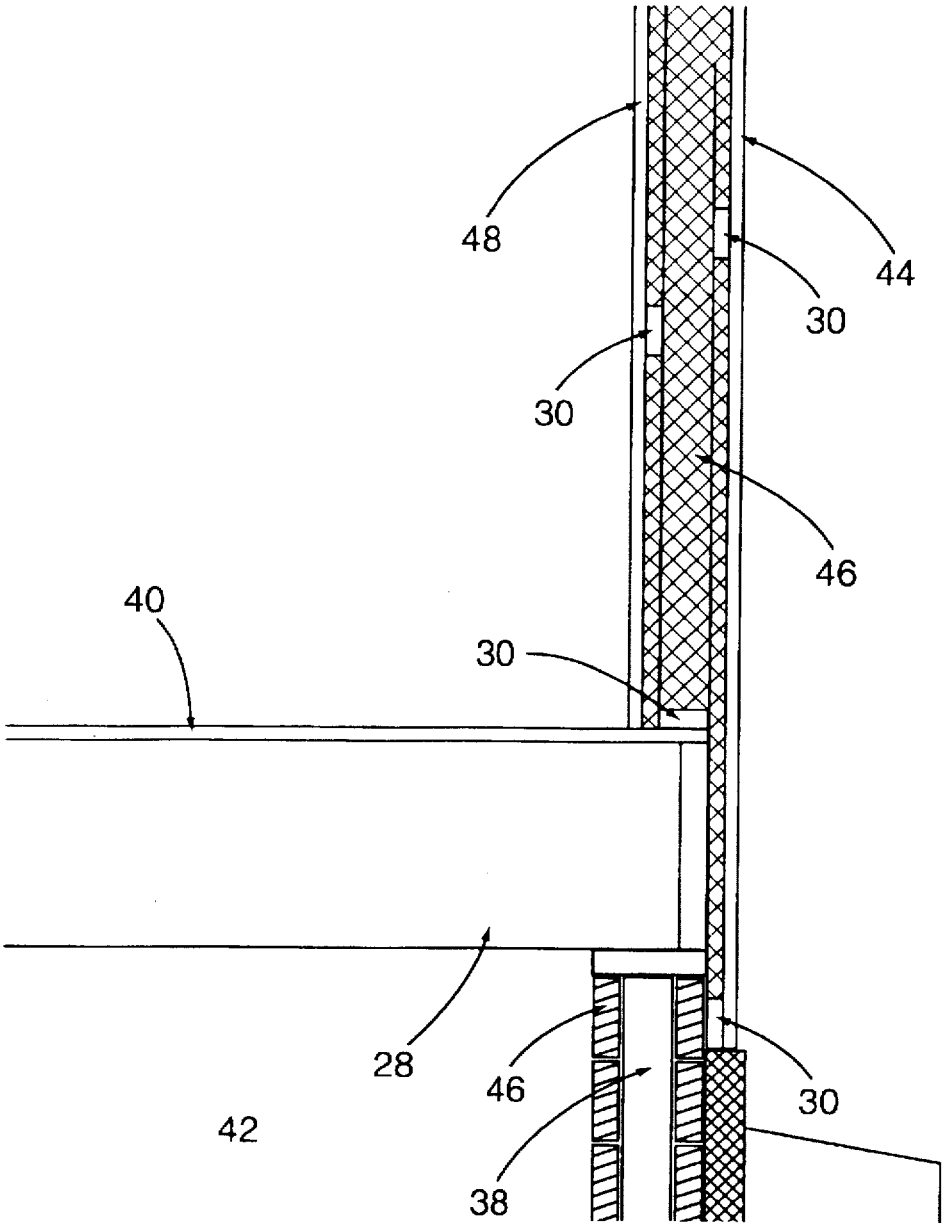
FIG. 2(*a*) shows a fragmentary sectional side view of the structure detailing the exterior wall, ground floor, and foundation.
Figure 2B:
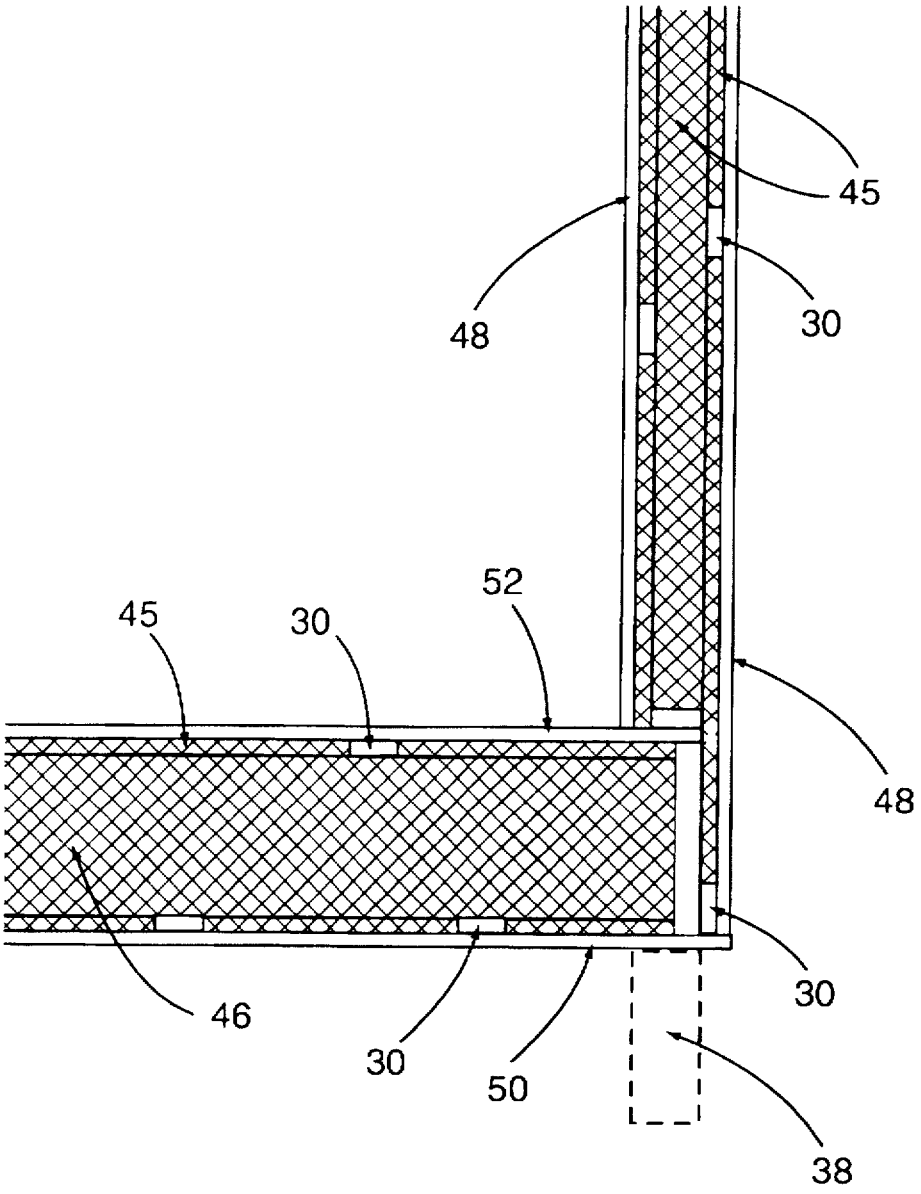

The ground floor 28 is shown in cross-section in FIG. 2(*b*). The ground floor 28 is supported by joists 22 and also has transverse support members 30. The lowermost side of the floor 28 is covered with a soffit skin material 50, and the uppermost side of the floor is also covered with a skin 52. Skins 52 and 50 are bonded to insulation material 46. The floor 28 and walls 26 are connected by intersecting core framing members 22 which are securely fastened by an appropriate fastening means such as nails.

Figure 3:
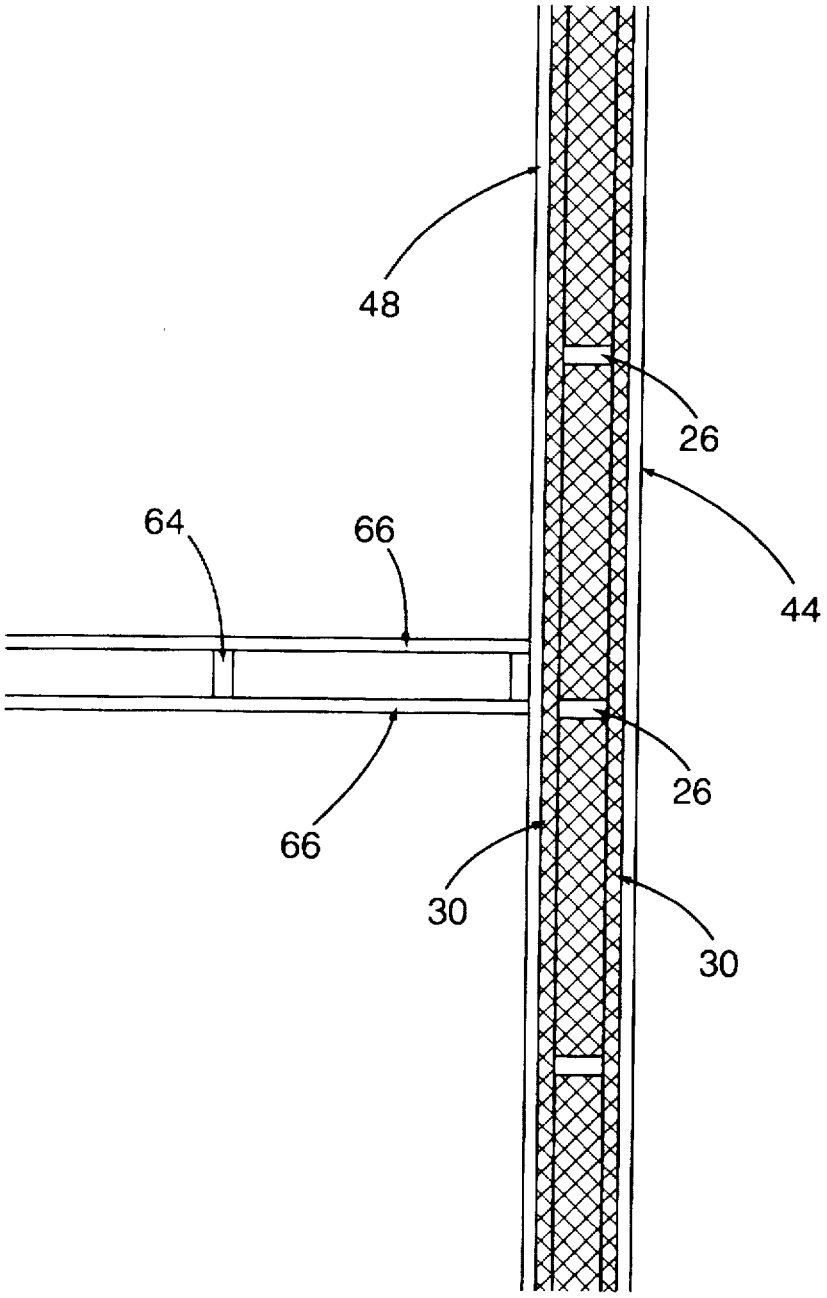
FIG. 3 shows a fragmentary sectional top view detailing the intersection of a interior wall and an exterior wall.

FIG. 3 shows a sectional top view of an interior wall 60 and an exterior wall skin 62. The exterior wall 62 is supported by vertically extending core framing members 22 to which support members 30 are fastened. The interior walls 60 are conventional having vertically extending wall studs 64 to which is fastened sheathing 66. The stud 64 adjacent to the exterior wall 62 is secured to support members 30 through interior wall skin 48.

Figure 4:
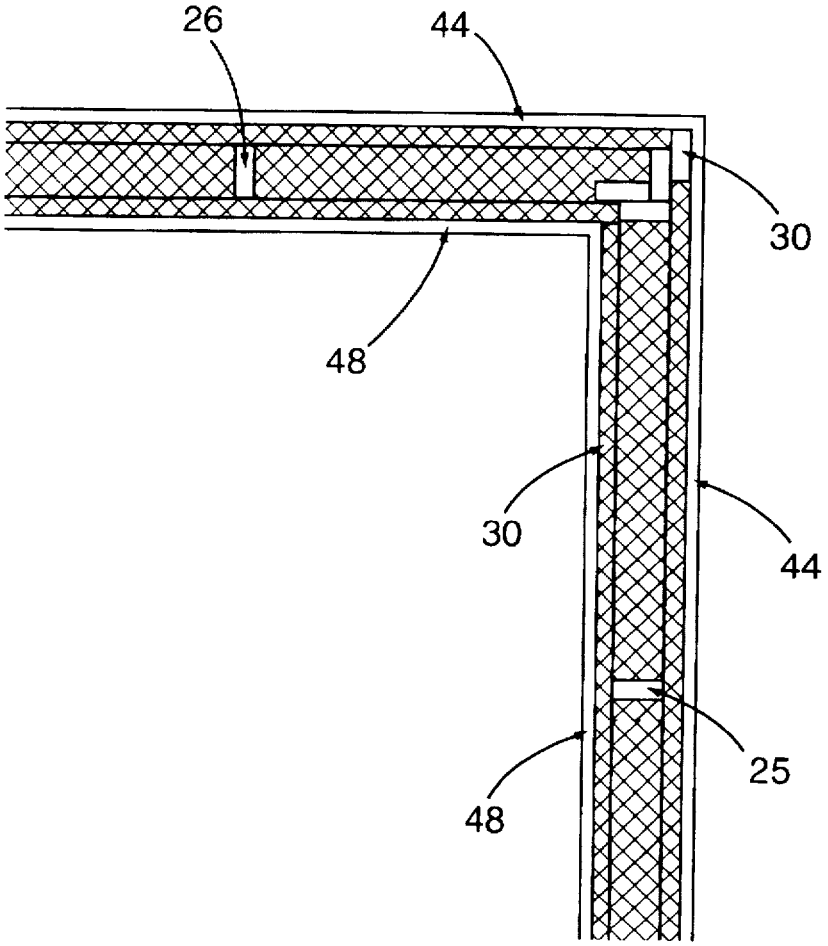
FIG. 4 shows a fragmentary sectional top view of the exterior walls detailing a corner section.

As has been previously mentioned, a limited amount of heat loss will occur where walls 26, floors 28, or roof 24 intersect. FIG. 4 shows vertically extending joists 22 in cross section. The core framing members 22 are fastened together thus resulting in a limited path for thermal conduction.

Figure 5:
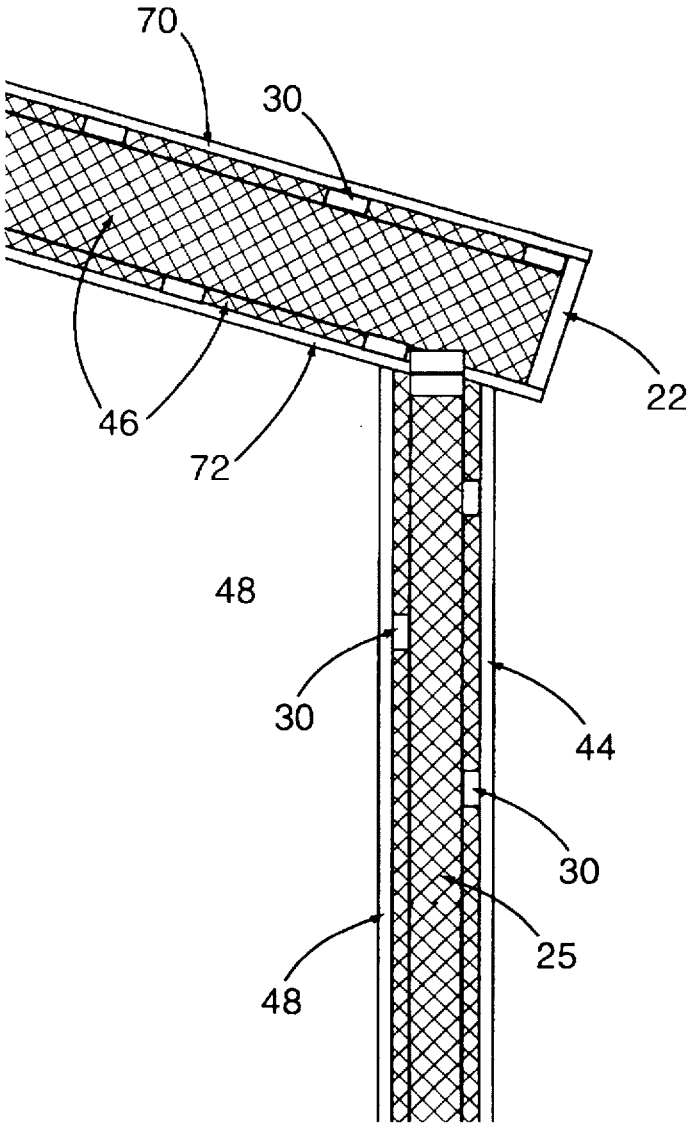
FIG. 5 shows a fragmentary sectional side view detailing the intersection of an exterior wall and the roof.

The roof 24 is secured to the topmost portion of the exterior wall 26 is shown in cross section in FIG. 5. Although a sloping roof 24 is shown a flat roof 24 can be employed as well. The roof 24 is supported by core framing members 22 which also serve to connect the roof to the exterior walls 26. Support members 30 are fastened to the roof core framing members 22 in the same fashion as the support members in the walls 26. A roof skin 70 and ceiling skin 72 are secured to support members 30. Insulation material 46 is bonded to roof skin 70 and the ceiling skin 72 so that the roof is insulated in the same manner as the floor 28 and the walls 26. Thus it can be appreciated that the structure of the present invention provides a complete and substantially continuous thermal barrier between the exterior and interior of the structure resulting in a reduced heat loss (or heat gain) while maintaining structural integrity. The composite structure exhibits excellent resistance to shearing and bending forces, and the rigid insulation core develops high resistance to both heat and vapor transmission.

Now the method of forming the composite structure of the present invention will be described.

Referring again to FIG. 1, a subframe of core framing members 22 is constructed, the subframe having floor, wall, and roof framing members 22. Transverse support members 30 are secured to opposite sides of the core framing members 22 using nails or other suitable fastening means, the support members 30 forming inner and outer boundaries for the floor 28, walls 26, and roof 24. The support members 30 create a space between the core framing members 22 and the interior skin 44 and the exterior skin that is filled with rigid insulation 46 to create a thermal barrier.

After the frame 20 having core framing members 22 and support members 30 is completed, the exterior of interior skins are added, preferable in the form of plywood sheets. The sections of plywood sheets are joined together by wooden spacers to which adjacent sheets are nailed. To further strengthen the overall structure, a bead of construction grade mastic can be run along the length of the spacer. The bead should be immediately covered by the edge of the adjacent plywood sheet thereby bonding the sheet to the spacer. The sheet can then be nailed to the spacer. An advantage of using this method is that the possibility of overexpansion shell damage is substantially reduced. Sections of the skin for the other face of the floor, wall or ceiling are then applied to form a shell having an interior core space.

Under proper surface and temperature conditions, the components of the liquid insulating material are combined by direct mixing or by proportioning pumps. Any commercially available liquid insulating material may be used provided it will dry with sufficient density to provide the required insulation without compromising structural integrity or posing an undue fire hazard.

When the insulation material 46 hardens it bonds to the interior and exterior skins, as well as the core framing members 22 and support members 30 thereby forming a composite shell section. Due to the bonding of the insulation, the shell section has superior strength to a standard frame in addition to its superior insulating properties. Since the insulation material 46 is poured in one section at a time no air pockets are created thereby reducing the fire hazard associated with prior insulation techniques.

While pouring the insulation material 46, means for collecting the overflow material (not shown) should be employed to avoid excessive spillage of insulation material onto the frame. Of course, care should be taken to avoid splashing which may lead to the formation of air pockets.

The shell section should be filled and allowed to dry before filling the next section. The problem of overexpansion shell damage is avoided using this method since the core framing members 22 in combination with the hardened adjacent shell section provide support for the liquid insulation 46 thereby limiting excessive fluid pressure at the bottom of a shell section.

By forming the shell sections on site, the problem of damage during transportation is eliminated. Damage occurring during shipping of prior art preassembled shell sections results in expensive repairs, if the damage is detected. Of course not all damage is readily detected, resulting in compromised structural integrity. Of course, the prohibitive costs of shipping the preassembled shell sections is avoided. It should further be noted that the method of the present invention can be performed using conventional framing tools.

When the roof 24, floor 28, and wall 26 sections are completed the composite structure of the present invention is completed and ready for the addition of floor, wall, and roof finishes.

What is claimed is:

1. A composite building structure comprising:

a frame, the frame having a plurality of main and secondary support members;

each of said main support members having an interior facing edge and an exterior facing edge;

a first group of secondary support members defining an inner wall boundary and a second group of secondary support members defining an outer wall boundary, all of said secondary support members having interior and exterior facing surfaces, said first group of secondary support members attached to one side of the frame along the interior edges of said main support members, and said second group of secondary support members attached to the opposite side of said frame along the exterior edges of said main support members, in staggered relation to said first group of secondary support members;

wall skin sections secured to the exterior surfaces of both said first and second group of secondary support members;

and formed in place rigid insulation bonded to said wall skin sections and said main and secondary support members.

* * * * *